US007089709B2

(12) United States Patent
Waggoner

(10) Patent No.: US 7,089,709 B2
(45) Date of Patent: Aug. 15, 2006

(54) SIDING HAVING INDICIA DEFINING A FASTENING ZONE

(75) Inventor: Kurt Waggoner, Kingston, WA (US)

(73) Assignee: Shear Tech, Inc., Kingston, WA (US)

( * ) Notice: Subject to any disclaimer, the term of this patent is extended or adjusted under 35 U.S.C. 154(b) by 98 days.

(21) Appl. No.: 10/314,430

(22) Filed: Dec. 4, 2002

(65) Prior Publication Data

US 2004/0107663 A1 Jun. 10, 2004

(51) Int. Cl.
*E04D 1/00* (2006.01)

(52) U.S. Cl. ..... 52/518; 52/554; 52/520

(58) Field of Classification Search ..... 52/518, 52/555, 105, 520, 747.1, 784.1
See application file for complete search history.

(56) References Cited

U.S. PATENT DOCUMENTS 3,159,943 A * 12/1964 Sugar et al. ..... 52/278
3,682,212 A * 8/1972 Brewer ..... 144/353
3,807,113 A * 4/1974 Turner ..... 52/314
4,102,106 A * 7/1978 Golder et al. ..... 52/533
4,308,702 A * 1/1982 Rajewski ..... 52/519
4,356,673 A * 11/1982 Gailey ..... 52/127.1
4,422,266 A * 12/1983 Slocum et al. ..... 52/58
4,450,665 A * 5/1984 Katz ..... 52/522
4,468,909 A * 9/1984 Eaton ..... 52/541
5,224,318 A 7/1993 Kemerer
5,287,669 A * 2/1994 Hannah et al. ..... 52/518
5,305,569 A * 4/1994 Malmquist et al. ..... 52/309.8
5,857,303 A * 1/1999 Beck et al. ..... 52/520
6,030,447 A 2/2000 Naji et al.
6,049,987 A 4/2000 Robell
6,122,877 A 9/2000 Hendrickson
6,128,806 A * 10/2000 Shou-Mao ..... 16/113.1
6,145,265 A * 11/2000 Malarkey et al. ..... 52/555
6,170,215 B1 * 1/2001 Nasi ..... 52/521
6,269,603 B1 * 8/2001 Ross ..... 52/520
6,276,107 B1 * 8/2001 Waggoner et al. ..... 52/554
6,397,546 B1 6/2002 Malarkey et al.
6,526,710 B1 * 3/2003 Killen ..... 52/220.1
6,526,717 B1 * 3/2003 Waggoner et al. ..... 52/554
6,539,643 B1 4/2003 Gleeson (Continued)

FOREIGN PATENT DOCUMENTS

AU B1-60 655/80 3/1981

OTHER PUBLICATIONS

Kuroki et al., "Cement-Bonded Board Industry and Market in Japan and New Technology Developments", 1995.

*Primary Examiner*—Anita M. King
(74) *Attorney, Agent, or Firm*—Dorsey & Whitney LLP

(57) ABSTRACT

Siding panels having indicia indicating a zone into which fasteners should be placed, and methods for manufacturing and installing the panels are disclosed herein. In one embodiment, the siding includes a panel of siding material having a first edge extending along a first dimension, a second edge spaced apart from the first edge a first distance, and a first side with indicia. The indicia define a zone into which at least one fastener should be placed to install the panel. The zone extends along the first dimension and has a width of approximately 0.2 inch to approximately 0.3 inch. The zone has a center line spaced apart from the first edge a second distance of approximately 7 percent to approximately 22 percent of the first distance. The siding material is composed of a continuous, single fiber-cement compound including cement, silica, and cellulose fiber.

20 Claims, 4 Drawing Sheets

U.S. PATENT DOCUMENTS 6,572,697 B1 * 6/2003 Gleeson et al. ..... 106/705
6,715,240 B1 * 4/2004 Beck et al. ..... 52/105

2003/0056458 A1 3/2003 Black et al.

* cited by examiner

SIDING HAVING INDICIA DEFINING A FASTENING ZONE

TECHNICAL FIELD

The present invention generally relates to siding materials for use on exterior walls of houses and other structures. More particularly, the invention is directed toward panels of siding having indicia defining a zone into which a fastener should be placed to install the panel.

BACKGROUND

The exterior surfaces of houses and other structures are often protected by exterior siding products made from wood, vinyl, aluminum, bricks, stucco, fiber-cement, and other materials. Wood and fiber-cement siding products, for example, are generally panels, planks, or shakes that are "hung" on plywood or composite walls. Although wood siding products are popular, wood siding can become unsightly or even defective because it may rot, warp, or crack. Wood siding products are also highly flammable and subject to insect damage. Therefore, wood siding products have several drawbacks.

Fiber-cement siding products are relatively new and offer several advantages compared to other types of siding materials. Fiber-cement siding is generally a composite material composed of cement, silica sand, cellulose, and binders. To form fiber-cement siding panels and planks, a liquid fiber-cement composite is rolled or pressed into the shape of the panels or planks, and then the fiber-cement composite is cured. Fiber-cement siding is advantageous because it is nonflammable, weatherproof, and relatively inexpensive to manufacture. Moreover, fiber-cement siding does not rot and insects do not consume the fiber-cement composites.

Fiber-cement siding products are typically installed by a builder, a siding contractor at a particular job site, or a modular home manufacturer in a factory. To install fiber-cement siding panels, for example, the panels are cut to a desired length and then nailed to plywood or wood-composite panels in a manner similar to hanging panels of cedar siding. Some fiber-cement siding panels include a single embossed, horizontal line to assist the installer with the alignment and overlap distance of adjacent panels. Trim materials can be attached to the structure before or after the fiber-cement siding is installed. The fiber-cement siding and the trim materials are subsequently painted.

One concern with fiber-cement siding is that some installers do not or cannot read the installation instructions, and consequently fail to attach the fiber-cement siding to the structure properly, such as nailing the siding in an improper location. More specifically, installers sometimes place nails at a position that is either too high or too low on a panel when attaching the panel to a wall. When fiber-cement siding is installed using the blind nail method, nails that are placed too low on the panel will be visible even after the overlying panel of fiber-cement siding is attached. Alternatively, if the nail is placed too high on the panel, the bottom edge of an overlying panel may not lay against the top surface of the underlying panel. Consequently, the overlying panel may rattle when windows or doors in the structure are closed or in high winds. Moreover, a high nail on an overlying panel of fiber-cement siding may cause the panel to appear to be warping or buckling even though fiber-cement panels cannot warp or buckle because they are inert. This appearance creates a poor image for fiber-cement sidings, and consumers are very sensitive to siding failures.

Furthermore, improperly installed siding can void the warranty and be costly to repair. Therefore, there is a significant need to assist installers in properly attaching fiber-cement siding to structures.

SUMMARY

The present invention is directed toward siding materials having indicia defining a zone into which fasteners should be placed, and methods for manufacturing and installing these panels. In one embodiment, the siding panel includes a panel of siding material having a first edge extending along a first dimension, a second edge spaced apart from the first edge a first distance, and a first side with indicia. The indicia define a zone into which at least one fastener should be placed to install the panel. The zone extends along the first dimension and has a width of approximately 0.2 inch to approximately 0.3 inch. The zone has a center line spaced apart from the first edge a second distance of approximately 7 percent to approximately 22 percent of the first distance. The siding material is composed of a continuous, single fiber-cement compound including cement, silica, and cellulose fiber. In a further aspect of this embodiment, the indicia can include marks embossed and/or printed on the first side of the panel. The indicia can also include a first line and a second line spaced apart from the first line. In another aspect of this embodiment, the zone is a first zone, the indicia are first indicia, and the panel further includes second indicia defining a second zone that is spaced apart from the first zone.

In another embodiment of the invention, a siding panel includes a first longitudinal edge extending along a longitudinal dimension, a second longitudinal edge spaced apart from the first longitudinal edge by a first width transverse to the longitudinal dimension, and indicia. The indicia define a zone into which at least one fastener should be placed to install the panel. The zone extends along the longitudinal dimension and has a second width of approximately 0.2 inch to approximately 0.3 inch. The zone includes a center line that is spaced apart from the first longitudinal edge a first distance of approximately 0.7 inch to approximately 1.3 inches.

Another embodiment of the invention is directed to a method of manufacturing siding panels. The method includes forming indicia indicating a zone into which fasteners should be placed on a first side of the siding panel. The panel has a first edge extending along a first dimension and a second edge opposite the first edge. The zone extends along the first dimension and has a width of approximately 0.2 inch to 0.3 inch. The zone is also spaced apart from the first edge a distance of approximately 0.7 inch to approximately 1.3 inches. In a further aspect of this embodiment, forming indicia can include embossing, stamping, printing, and/or molding.

DETAILED DESCRIPTION

The following disclosure describes several embodiments of siding panels having indicia defining a fastening zone and methods for manufacturing and installing siding panels having indicia defining a fastening zone. The term "panel" is used throughout to include planks, shakes, and other siding materials. The term "fastener" is used throughout to include nails, screws, staples, adhesive, and any other fastening device or medium. Several embodiments of the invention are set forth in FIGS. 1A–4C and the following text to provide a thorough understanding of particular embodiments of the invention. A person skilled in the art will understand, however, that the invention may have additional embodiments or that the invention may be practiced without several of the details explained in the following description. For example, even though many specific details of the invention are described below with reference to fiber-cement siding and fiber-cement materials, the present invention can be practiced using other types of siding, such as wood/plastic composites, other composites of natural materials and synthetic materials, metal, or vinyl.

A. Siding Panels

Figure 1A:
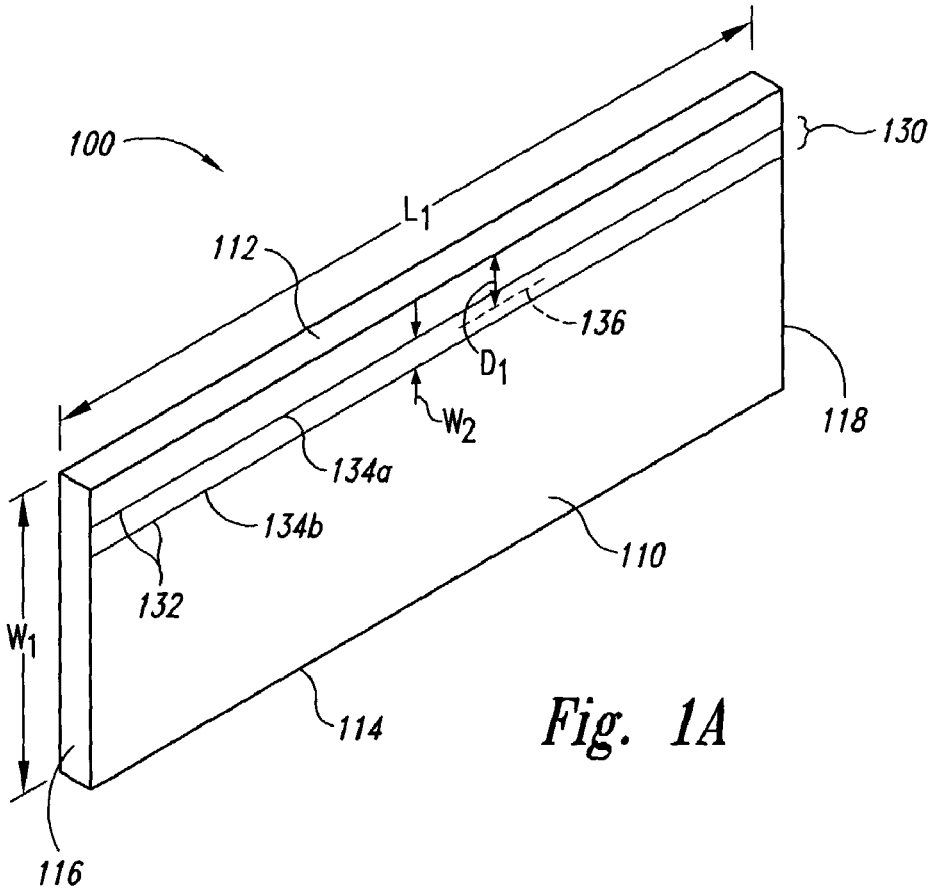
FIG. 1A is an isometric view of a siding panel for attachment to a wall of a structure in accordance with one embodiment of the invention.

FIG. 1A illustrates an embodiment of a siding panel 100 for attachment to a wall of a structure, such as an exterior wall of a house or other building. The panel 100 includes an upper longitudinal edge 112 extending along the longitudinal dimension, a lower longitudinal edge 114 opposite the upper longitudinal edge 112, a first end 116, and a second end 118 opposite the first end 116. The upper longitudinal edge 112 is spaced apart from the lower longitudinal edge 114 by a width $W_1$. In one embodiment, the width $W_1$ can be approximately 5¼ inches to approximately 12 inches; in a further aspect of this embodiment, the width $W_1$ can be approximately 9½ inches. In additional embodiments, the width $W_1$ can be less than 5¼ inches or greater than 12 inches. The first end 116 is spaced apart from the second end 118 by a length $L_1$. The length $L_1$ of the panel 100 is typically 12 feet but can be virtually any other length.

The panel 100 also includes a first side 110 having indicia 132 indicating a zone 130 into which at least one fastener should be placed to install the panel 100. The indicia 132 can include a first line 134*a* extending generally parallel to the upper longitudinal edge 112 and a second line 134*b* spaced apart from the first line 134*a* by a zone width $W_2$. In one embodiment, the zone width $W_2$ can be approximately 0.2 inch to approximately 0.3 inch; in a further aspect of this embodiment, the zone width $W_2$ can be approximately 0.25 inch. In other embodiments, the zone width $W_2$ can be greater than 0.3 inch or less than 0.2 inch. The first and second lines 134*a* and 134*b* can be solid or dashed lines that are embossed, stamped, printed, marked, molded or otherwise formed on the first side 110 of the panel 100. In the illustrated embodiment, the first and second lines 134*a* and 134*b* define the zone 130, which extends from the first end 116 to the second end 118. The zone 130 includes a center line 136 equidistant from the first and second lines 134*a* and 134*b*. The center line 136 can be spaced apart from the upper longitudinal edge 112 by a distance $D_1$ of approximately 1 inch to approximately 1.3 inches; in a further aspect of this embodiment, the distance $D_1$ can be approximately 1.125 inches. In other embodiments, the distance $D_1$ can be greater than 1.3 inches or less than 1 inch. In additional embodiments, the distance $D_1$ can be from approximately 7 percent to approximately 22 percent of the width $W_1$ of the panel 100. In other embodiments, such as those described below with reference to FIGS. 4A–4C, the indicia can include other marks besides solid, longitudinal lines.

Figure 1B:
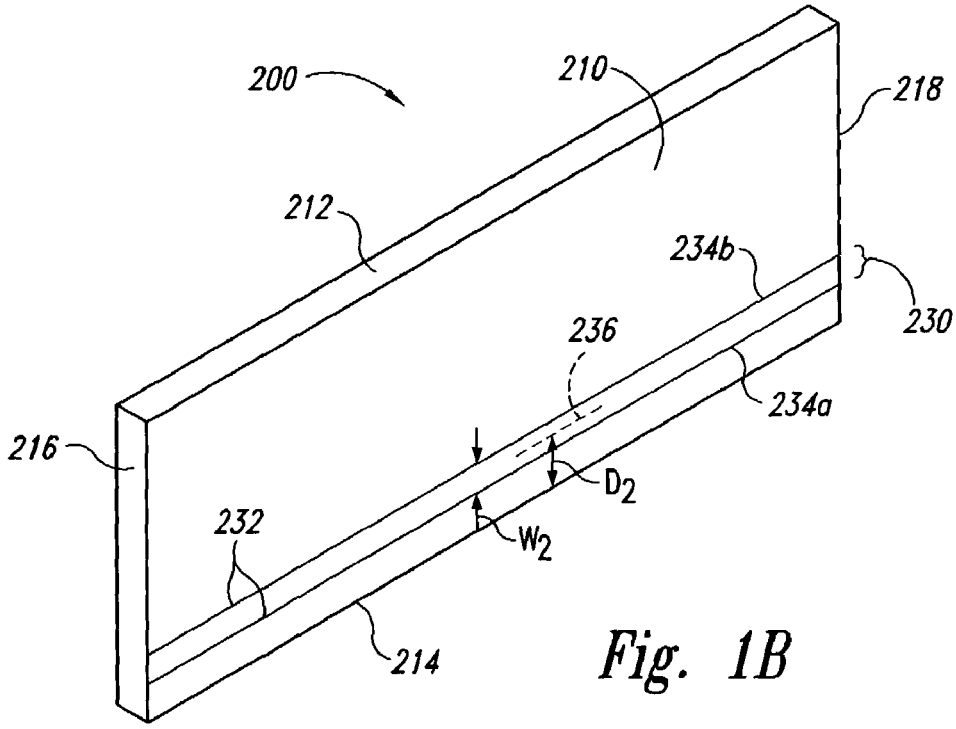
FIG. 1B is an isometric view of a siding panel in accordance with another embodiment of the invention.

FIG. 1B illustrates a siding panel 200 in accordance with another embodiment of the invention. The panel 200 is generally similar to the panel 100 discussed above with reference to FIG. 1A. For example, the panel 200 includes a first side 210, an upper longitudinal edge 212, a lower longitudinal edge 214 opposite the upper longitudinal edge 212, a first end 216, and a second end 218 opposite the first end 216. The first side 210 of the panel 200 has indicia 232 including a first line 234*a* extending generally parallel to the lower longitudinal edge 214 and a second line 234*b* spaced apart from the first line 234*a* by the zone width $W_2$. The first and second lines 234*a* and 234*b* define a zone 230. The zone 230 includes a center line 236 that is equidistant from the first and second lines 234*a* and 234*b* and spaced apart from the lower longitudinal edge 214 by a distance $D_2$. In one embodiment, the distance $D_2$ can be between approximately 0.7 inch and approximately 1.1 inches; in a further aspect of this embodiment, the distance $D_2$ can be approximately 0.875 inch. In other embodiments, the distance $D_2$ can be greater than 1.1 inches or less than 0.7 inch. In additional embodiments, the distance $D_2$ can be from approximately 7 percent to approximately 22 percent of the width of the panel 200.

B. Methods for Installing Siding Panels

Figure 2A:
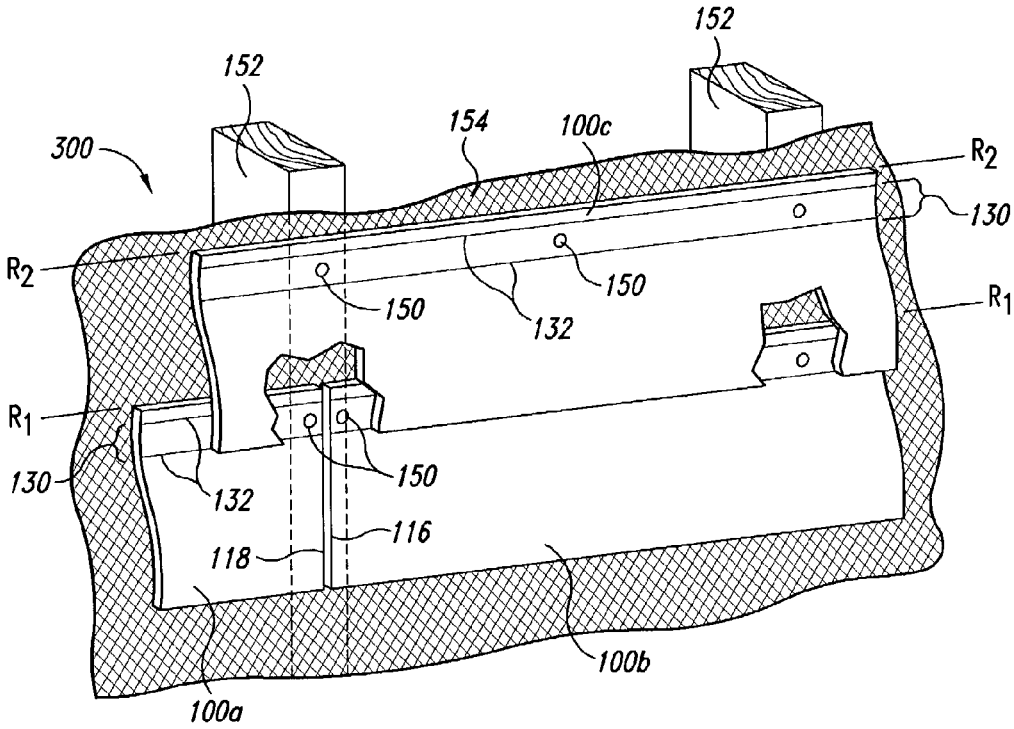
FIG. 2A is an isometric view of the siding panel of FIG. 1A attached to a wall.

FIG. 2A illustrates an embodiment of a method for installing siding panels 100 on a typical wall 300 using the blind nail method. A first siding panel 100*a* and a second siding panel 100*b* are attached to the wall 300 along a bottom row $R_1$—$R_1$. The first and second panels 100*a–b* are attached to studs 152 by driving fasteners 150 through the panels 100 and into the studs 152. In other embodiments, the fasteners 150 are driven into a sheet of plywood or wood composite hung on the studs 152. In either case, the fasteners 150 are placed within the zone 130 of the respective panels 100. After installation, the first and second panels 100*a–b* are coplanar and the first end 116 of the second panel 100*b* abuts the second end 118 of the first panel 100*a*. After installing the first and second panels 100*a–b* along the bottom row $R_1$—$R_1$, a third panel 100*c* can be installed along an upper row $R_2$—$R_2$ overlapping the zones 130 of the first and second panels 100*a–b*. The third panel 100*c* can overlap the first and second panels 100*a–b* to hide the indicia 132 marking the zones 130 and the fasteners 150. The third panel 100*c* is also attached to the studs 152 or an underlying sheet by additional fasteners 150 placed in the zone 130 of the third panel 100*c*. A weather-resistive barrier 154 can also be placed between the panels 100 and the studs 152.

Figure 2B:
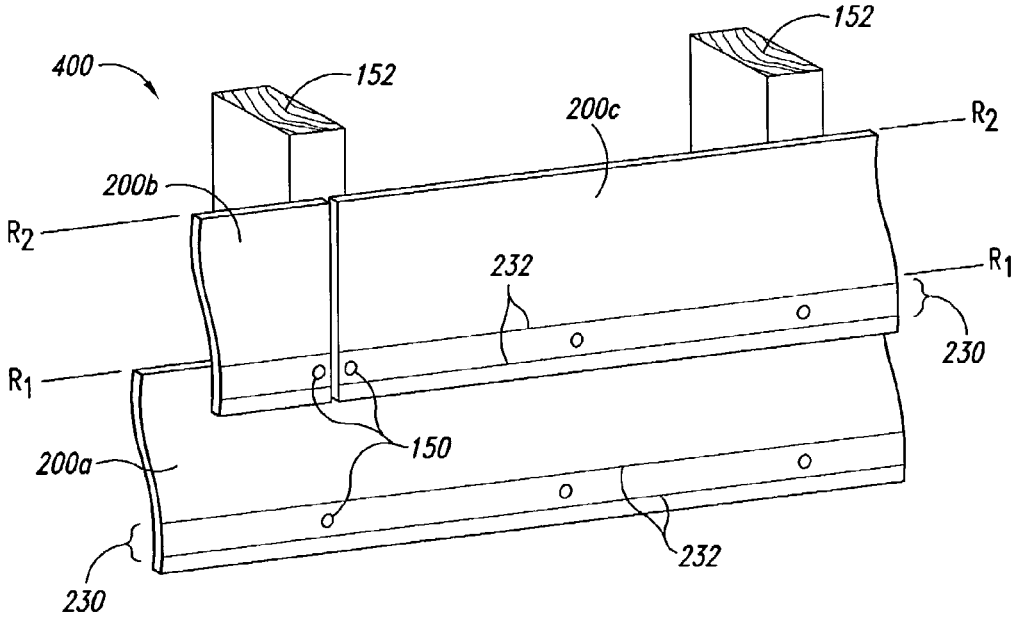
FIG. 2B is an isometric view of the siding panel of FIG. 1B attached to a wall.

FIG. 2B illustrates another embodiment for installing siding panels 200 on a typical wall 400 using the face nail method. The first siding panel 200*a* is attached to the wall 400 along the bottom row $R_1$—$R_1$ by fasteners 150. The fasteners 150 are placed in the zone 230 to attach the first panel 200*a* to the studs 152. After installing the first panel 200*a*, the second and third panels 200*b–c* are installed along the upper row $R_2$—$R_2$. A portion of the second and third panels 200*b–c*, including the zones 230, overlap a top portion of the first panel 200*a*. Accordingly, the second and third panels 200*b–c* are attached by driving fasteners 150 into the zones 230 of the second and third panels 200*b–c*, through the first panel 200*a*, and into the studs 152 or an underlying sheet of wood or wood composite.

One advantage of the panels illustrated in FIGS. 1A–2B is that the zones with two lines provide a definite indication of where to place the fasteners. Accordingly, the panels are expected to decrease the number of panels that are improperly attached to a structure. The panels are also expected to be less likely to rattle when doors or windows are closed or have the appearance of buckling and/or warping. Moreover, the panels are expected to reduce the number of costly repairs that involve refastening improperly attached panels. Furthermore, the clear indication of where to place the fasteners should allow the installers to attach the siding to the walls more quickly.

C. Methods for Manufacturing Siding Panels

Figure 3:
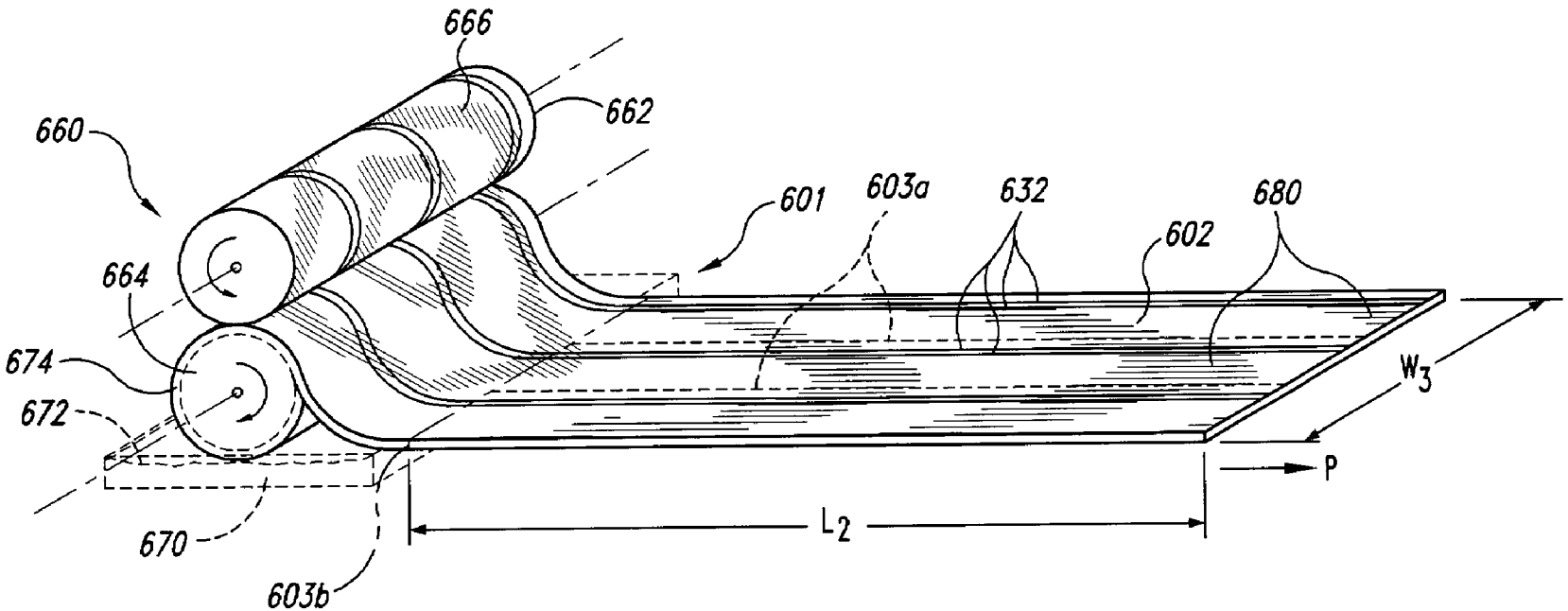
FIG. 3 is a schematic isometric view of a method for manufacturing a sheet of fiber-cement siding material in accordance with one embodiment of the invention.

FIG. 3 illustrates an embodiment of a method for manufacturing siding panels composed of fiber-cement material. A long sheet 601 of fiber-cement siding material is formed through a roller assembly 660 having a first roller 662 and a second roller 664. The first roller 662 has a grain pattern 666 and the second roller 664 is partially submerged in a container 670 holding a fiber-cement slurry 672. In operation, the second roller 664 rotates through the slurry 672 and picks up a layer 674 of fiber-cement siding material. The first roller 662 rotates with the second roller 664 to press the fiber-cement layer 674 to a desired sheet thickness and to emboss indicia 632 onto the long sheet 601. The indicia 632 extend generally parallel to a travel path "P" of the sheet 601. The first roller 662 can also emboss a grain pattern 680 onto the long sheet 601. The grain pattern 680 also runs generally parallel to the travel path "P" of the sheet 601. In other embodiments, the first roller 662 may not emboss the grain pattern 680 onto the long sheet 601. The fiber cement sheet 601 is composed of a continuous, single layer of fiber-cement compromising cement, silica, cellulose fiber, and binders. After the long sheet 601 is formed, water jets cut the long sheet 601 along lines 603*a* and along line 603*b* to form long panels 602 of fiber-cement siding material. In other embodiments, panels of fiber-cement siding can be manufactured using other methods, such as pressing and curing a fiber-cement slurry.

D. Other Siding Panels

Figure 4A:
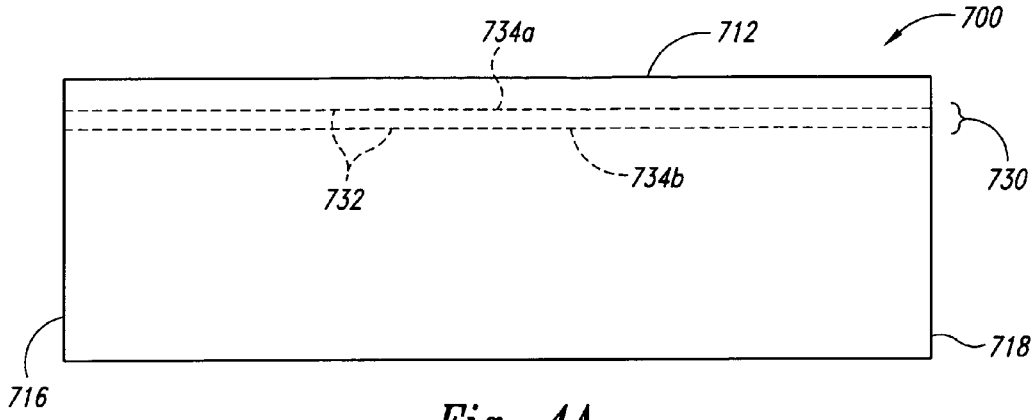
FIG. 4A is a front view of a siding panel having indicia in accordance with another embodiment of the invention.
Figure 4B:
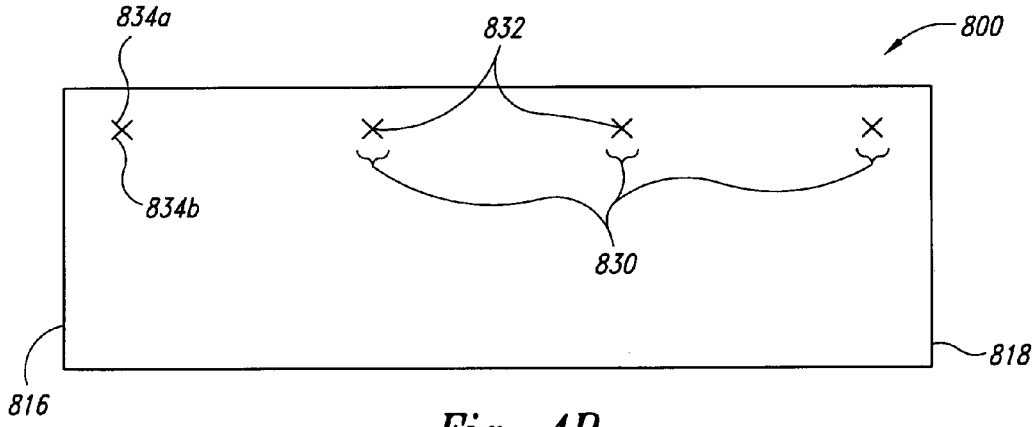
FIG. 4B is a front view of a siding panel having a plurality of indicia in accordance with another embodiment of the invention.
Figure 4C:
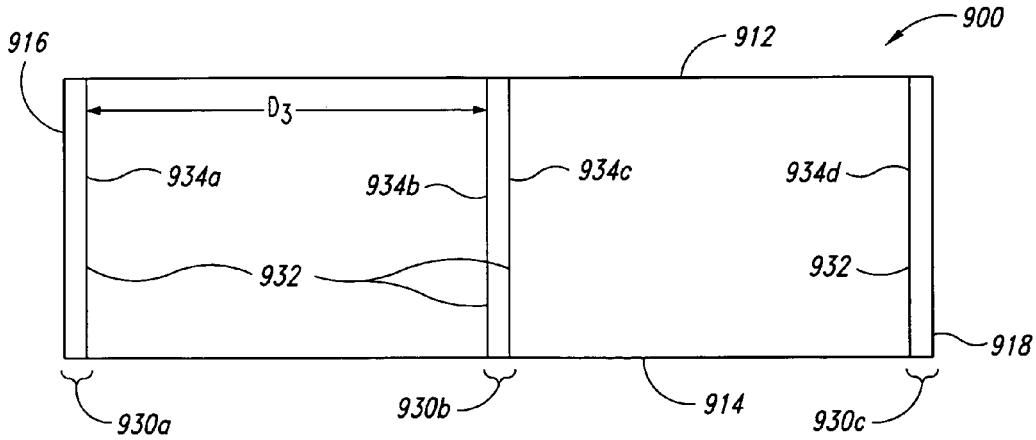
FIG. 4C is a front view of a siding panel having a plurality of indicia indicating transverse zones in accordance with another embodiment of the invention.

FIGS. 4A–4C illustrate several possible configurations of indicia defining zones on siding panels in accordance with additional embodiments of the invention. Each figure illustrates a different arrangement of indicia defining a zone with a different size and/or orientation. Each arrangement of indicia, however, can be used to define any of the zones. For example, the indicia in FIG. 4B can be used to define the zones in FIG. 4C.

FIG. 4A illustrates a siding panel 700 having indicia 732 extending between a first end 716 and a second end 718 in accordance with another embodiment of the invention. The indicia 732 include a first line 734*a* extending generally parallel to a longitudinal edge 712 and a second line 734*b* spaced apart from the first line 734*a*. The first and second lines 734*a–b* are dashed lines that define a zone 730. In additional embodiments, the zone may not extend completely from the first end 716 to the second end 718. For example, the zone can include several discrete sections extending generally parallel to the longitudinal edge.

FIG. 4B illustrates a siding panel 800 having a plurality of indicia 832 defining a plurality of zones 830 in accordance with another embodiment of the invention. The indicia 832 include first and second lines 834*a–b* forming "X"s; each "X" defines a zone 830. The zones 830 are spaced apart from each other between a first end 816 and a second end 818 opposite the first end 816. In other embodiments, the indicia 832 can include marks with other shapes and/or sizes, such as circles or rectangles.

FIG. 4C illustrates a siding panel 900 having a plurality of indicia 932 indicating a plurality of zones 930 in accordance with another embodiment of the invention. The indicia 932 include lines (identified individually as 934*a–d*) that extend between an upper longitudinal edge 912 and a lower longitudinal edge 914 opposite the upper longitudinal edge 912. A first line 934*a* and a first end 916 define a first zone 930*a*. Second and third lines 934*b –c* define a second zone 930*b*. A fourth line 934*d* and a second end 918 define a third zone 930*c*. In one aspect of this embodiment, the zones 930 can be spaced apart from each other a distance $D_3$ at least approximately equal to the distance between studs (FIGS. 2A and 2B). In other embodiments, the panel 900 can include a different number of transverse zones 930. In additional embodiments, the panel 900 may also include indicia defining a zone that extends generally parallel to the upper longitudinal edge 912, such as the zones described above with reference to FIGS. 1A, 1B, 4A, and 4B.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A siding piece, comprising:

a panel of siding material including a first edge extending along a first dimension, a second edge spaced apart from the first edge a first distance, and a first side having indicia defining a zone into which at least one fastener should be placed to install the panel, the zone extending along the first dimension and having a width of approximately 0.2 inch to approximately 0.3 inch, wherein the zone has a center line spaced apart from the first edge a second distance of approximately 7 percent to approximately 22 percent of the first distance, wherein the siding material is composed of a continuous, single fiber-cement compound comprising cement, silica, and cellulose fiber, wherein the zone is a first zone and the indicia are first indicia, wherein the panel further includes second indicia defining a second zone into which at least one fastener can be placed, and wherein the second zone is spaced apart from the first zone.

2. The siding piece of claim 1 wherein the first and second indicia comprise ink marks on the panel.

3. The siding piece of claim 1 wherein the first and second indicia comprise marks embossed on the panel.

4. The siding piece of claim 1 wherein the first and second indicia comprise marks printed on the panel.

5. The siding piece of claim 1 wherein the first and second indicia comprise marks stamped on the panel.

6. A siding piece, comprising:

a panel including a first longitudinal edge extending along a longitudinal dimension, a second longitudinal edge spaced apart from flue first longitudinal edge by a first width transverse to the longitudinal dimension, and indicia defining a zone into which at least one fastener should be placed to install the panel, the zone extending along the longitudinal dimension and having a second width of approximately 0.2 inch to approximately 0.3 inch, wherein the zone has a center line spaced apart from the first longitudinal edge a first distance of approximately 0.7 inch to approximately 1.3 inches, wherein the panel is composed of a continuous, single fiber-cement compound comprising cement, silica, and cellulose fiber, wherein the zone is a first zone and the inclicia are first indicia, wherein the panel further includes second indicia defining a second zone into which at least one fastener can be placed, and wherein the second zone is spaced apart from the first zone.

7. The siding piece of claim 6 wherein the first and second indicia comprise ink marks on the panel.

8. The siding piece of claim 6 wherein the first and second indicia comprise marks embossed on the panel.

9. The siding piece of claim 6 wherein the first and second indicia comprise marks printed on the panel.

10. The siding piece of claim 6 wherein the first and second indicia comprise marks stamped on the panel.

11. A siding piece, comprising:

a panel including a first longitudinal edge extending along a longitudinal dimension, a second longitudinal edge spaced apart from the first longitudinal edge, and indicia defining a zone into which at least one fastener should be placed to install the panel, the indicia including a first line and a second line spaced apart from the first line a first distance of approximately 0.2 inch to approximately 0.3 inch, wherein the panel is composed of a continuous, single fiber-cement compound comprising cement, silica, and cellulose fiber, and wherein the first and second lines are printed on the panel to define the zone.

12. The siding piece of claim 11 wherein the first and second lines comprise ink marks on the panel.

13. The siding piece of claim 11 wherein the zone includes a center line spaced apart from the first longitudinal edge by a second distance of approximately 0.7 inch to approximately 1.1 inches.

14. The siding piece of claim 11 wherein the zone includes a center line spaced apart from the second longitudinal edge by a second distance of approximately 1 inch to approximately 1.3 inches.

15. The siding piece of claim 11 wherein the panel further includes a first end and a second end opposite the first end, and wherein the first and second lines extend from at least proximate to the first end to at least proximate to the second end.

16. A siding piece, comprising:

a panel including a first longitudinal edge extending along a longitudinal dimension, a second longitudinal edge spaced apart from the first longitudinal edge, and indicia defining a zone into which at least one fastener should be placed to install the panel, the indicia including a first line and a second line spaced apart from the first line a first distance of approximately 0.2 inch to approximately 0.3 inch, wherein the panel is composed of a continuous, single fiber-cement compound comprising cement, silica, and cellulose fiber, wherein the zone is a first zone and the indicia are first indicia, wherein the panel further includes second indicia defining a second zone into which at least one fastener can be placed, and wherein the second zone is spaced apart from the first zone.

17. The siding piece of claim 16 wherein the first and second lines comprise ink marks on the panel.

18. The siding piece of claim 16 wherein the first and second indicia comprise marks embossed on the panel.

19. The siding piece of claim 16 wherein the first and second indicia comprise marks printed on the panel.

20. The siding piece of claim 16 wherein the first and second indicia comprise marks stamped on the panel.

* * * * *